United States Patent [19]

Lohwasser et al.

[11] 4,013,753

[45] Mar. 22, 1977

[54] PROCESS FOR THE PRODUCTION OF SPONTANEOUSLY CRIMPING POLYACRYLONITRILE COMPOSITE FIBRES WITH IMPROVED CRIMP PROPERTIES

[75] Inventors: Hermann Lohwasser; Alfred Nagaj; Horst Wieden, all of Dormagen, Germany

[73] Assignee: Bayer Aktiengesellschaft, Leverkusen, Germany

[22] Filed: Sept. 30, 1974

[21] Appl. No.: 510,576

[30] Foreign Application Priority Data

Oct. 9, 1973 Germany ..... 2350632

[52] U.S. Cl. ..... 264/168; 264/171; 264/210 F; 264/206

[51] Int. Cl.[2] ..... D01D 5/22

[58] Field of Search ..... 264/182, 206, 171, 210 F, 264/168

[56] References Cited

UNITED STATES PATENTS

| | | | |
|---|---|---|---|
| 2,249,756 | 7/1941 | Finzel | 264/168 |
| 2,728,631 | 12/1955 | Drasch et al. | 264/168 |
| 3,038,237 | 6/1962 | Taylor | 264/171 |
| 3,039,524 | 6/1962 | Belck et al. | 264/171 |
| 3,102,323 | 9/1963 | Adams | 264/290 |
| 3,122,412 | 2/1964 | Menault | 264/168 |
| 3,150,223 | 9/1964 | Stuchlik et al. | 264/168 |
| 3,547,763 | 12/1970 | Hoffman | 264/171 |
| 3,663,676 | 5/1972 | Lulay | 264/171 |
| 3,737,504 | 6/1973 | Hertbach et al. | 264/168 |
| 3,802,954 | 4/1974 | Orato et al. | 57/140 R |
| 3,827,932 | 8/1974 | Orato et al. | 8/130.1 |
| 3,828,014 | 8/1974 | Wieden et al. | 264/206 |

FOREIGN PATENTS OR APPLICATIONS

| | | | |
|---|---|---|---|
| 43-551 | 1/1968 | Japan | 264/171 |

*Primary Examiner*—Jay H. Woo
*Attorney, Agent, or Firm*—Plumley and Tyner

[57] ABSTRACT

The invention relates to a process for the production of spontaneously crimping composite fibres of acrylonitrile polymers wherein the dry-spun-filaments which still contain solvent are stretched to at least three times their original length in a bath of hot water which contains from 12 to 30 % by weight of dimethyl formamide. The stretching operation may be carried out in one or two stages.

7 Claims, No Drawings

PROCESS FOR THE PRODUCTION OF SPONTANEOUSLY CRIMPING POLYACRYLONITRILE COMPOSITE FIBRES WITH IMPROVED CRIMP PROPERTIES

The invention relates to a process for the production of spontaneously crimping polyacrylonitrile composite fibres with improved crimp properties under certain stretching conditions.

In the field of acrylonitrile polymers, numerous types of composite filaments and fibres are known in which the capacity to form crimp arcs is based on differences in the chemical composition and physical nature of the fibre components. The spinning and after-treating processes for these filaments and fibres, (hereinafter briefly referred to as "fibres"), are known to one skilled in the art.

With regard to the wearing properties of textile articles produced from the known composite fibres, however, it has not yet been possible to obtain a substitute for wool which is satisfactory in all respects. When composite fibres are used, e.g. for hand and machine-knitted goods, the crimp of the raw fibre must not be too pronounced initially but should, if possible, only develop fully at a later stage of the textile process. The reason for this is that an unduly tight fibre crimp may result in non-uniform product quality due to excessive adherence of the fibre in the carding process or to stretching difficulties in the spinning process. An unduly tight crimp is particularly damaging to the appearance and hand of the finished acrylic product, in particular lustre, softness, bulk, elasticity, firmness. It is also well known that there is a connection between excessive fibre crimping and the tendency to form pills or to felting in the finished article.

A viable acrylic composite fibre should therefore have a medium strong, permanent and soft crimp when made up into a textile, (the term "soft" being used to denote the capacity of the bound fibres, e.g. in yarn plied twine or stitch, to remain substantially elastic and resistant to felting while under deformation.

It is an object of this invention to provide a process for the production of composite fibres of acrylonitrile polymers which acquire this type of crimp as a result of the particular manufacturing process and may therefore be made-up into yarns and knitted goods which have improved wearing properties.

Other objects will be evident from the description and the examples.

These objects are accomplished by a process for the production of spontaneously crimping polyacrylonitrile composite fibres which comprises side-by-side spinning of two different acrylonitrile polymers in dimethylformamide solution by the dry-spinning process, stretching the fibres which still contain solvent to at least three times their original length in a bath of hot water which contains from 12 to 30%,by weight, dimethylformamide and drying the stretched fibres under tension or under conditions of partical shrinkage.

The process according to the invention is carried out as follows: acrylic composite fibres with the fibre components in a side-by-side arrangement in proportions of from 50:50 to 35:65 are produced by a dry-spinning process in which the solutions of the components in dimethylformamide are spun together through suitable spinning dyes. The spinning fibres are stretched in hot water to several times their original length. The concentration of dimethylformamide in the water used for stretching must be at least 12%, by weight. The stretching ratio should be at least 1 : 3 so that the acrylic fibres with have good mechanical properties and crimp stability under stress. Stretching ratios of from 1:3.0 to 1:4.5 are preferably employed. The fibres are then subjected to a moist heat treatment under tension or condition of partial shrinkage. To develop the spontaneous crimp, the fibres may then be treated with steam or hot water under tension-free conditions, optionally after an additional mechanical crimping in a crimper box, and finally dried.

The presence of substantial quantities of dimethylformamide in the stretching bath is the most important feature of the present process. The concentration and time of action of the dimethylformamide are so regulated that, before drying, the fibres have a higher residual solvent content than in a normal after-treatment. The concentration employed are preferably from 16 to 26%, by weight, based on the total quantity of liquid. If this condition is observed, the fibres may also be passed through additional water-baths after stretching or between two stages of stretching in order to make the fibre cable more uniform. These additional water-baths should contain from 12 to 20%, by weight, dimethylformamide. The moist fibres, which still contain solvent, are optionally brightened and then dried at temperatures above 100° C, whereby most of the volatile constituents are removed. The crimp may then be developed by shrinking the fibres, preferably by steaming, after the fibre cable has been cut up to the desired staple length. The crimp which is already present is stabilized simultaneously by this process.

The process is particularly suitable for application to those polyacrylonitrile composite fibres in which the components differ in the proportions of polymerised carboxylic acid esters of the acrylic or vinyl-types contained therein. In all cases, the polymers should contain at least 85%, by weight, of copolymerised acrylonitrile. The fibres then obtained have excellent resistance to splitting and good dye adsorption. Textile articles produced from these fibres have an attractive gloss.

Combinations of acrylonitrile homopolymers with copolymers and/or polymer mixtures may also be used according to the invention provided the fibres which may be spun from them have a sufficient capacity for spontaneous crimping. The following are examples of compounds which may be copolymerised with acrylonitrile: methyl acrylate, vinyl acetate, methacrylonitrile, acrylamide, vinyl chloride, styrene, N-vinylpyrrolidone, N,N-dimethylaminoethylmethacrylate, methallylsulphonic acid, etc.. Bicomponent fibres which contain particular additives, such as matting agents, spinning dyes, stabilizers, flame retarding agents, etc., may also be used according to the invention provided these additives have no deleterious effect on the hand.

In contrast to the present process, it is customary in the after-treatment of dry-spinning material to wash out the solvent during the after-stretching process as far as possible for economic reasons. Therefore, to partially remove the solvent by washing and then to remove the residual solvent in the stretched cable by drying or steaming is a novel idea. This method even affords economic advantages if suitable recovery techniques are employed. It was not forseeable that as a result of this method the crimp properties and wearing quality of acrylic composite fibres would be improved.

The effect of the present process may be seen in fibres with a medium to fine titre, (approximately 7 to 2 dtex) by the fact that the products produced from them become soft, bulky and elastic in the dyeing process without the addition of fibre bulking admixtures whereas articles produced from similar fibres with the conventional after-treatment involving washing-out the dimethylformamide have a rougher, denser and less springy texture. The excellent wearing quality of textile fibre articles according to the invention may always be restored by mild washing.

The following Examples are to further illustrate the invention without limiting it.

EXAMPLES

The features of improved texture and hand compared with goods manufactured in the conventional way may easily be determined and assessed qualitatively by testers. In the experimental examples, raw yarns (Nm 16/4) were dyed in a hank dyeing apparatus for full development of their bulk and surface structure, dried, made-up into uniform knitted samples, atmospherically conditioned and then tested subjectively by a group of persons.

The composition figures given below are percentages by weight.

Comparison to Example 1

Polymers of the composition

A. 93.4% acrylonitrile, 5.6% methylacrylate, 1.0% methacroylaminobenzene-benzenedisulphonimide; and B. 89.3% acrylonitrile, 9.8% vinyl acetate, 0.9% methacroylaminobenzene-benzenedisulphonimide; were spun side-by-side, in a 50:50 ratio to produce composite fibres with a solvent content of about 18 % dimethylformamide. A fibre cable with a total mass per length of 88g/m was stretched by a total ratio of 1 : 3.6 in two stages in fresh water at 98° C, passed through a finishing bath and dried under tension at 120° C. The cable was mechanically crimped and cut up into staple fibres which were then steamed at 110° C under normal pressure. The residual solvent content was then 1.5%, the remaining boiling shrinkage 2.4%. The fibre had a titre of 4.8 dtex, a tensile strength of 2.5 g/dtex and an elongation on tearing of 50%. It developed 8.9 crimp arcs per cm after boiling and drying at 80° C.

EXAMPLE 1

The above-described procedure was modified by inserting an additional stage between the two stretching sections. The dimethylformamide contents in the preliminary stretching vat, additional vat and main stretching vat were 24.1% 12.6% and 14.5% respectively. The fibres contained 3.9% dimethylformamide after drying and 1.3% after steaming. The residual boiling shrinkage was 0.4%, and the development of crimp 7.0 crimp arcs per cm. The titre of the fibres was 5.0 dtex, the tensile strength 2.8 g/dtex and the elongation on tearing 44%.

Knitting samples were prepared from fibres treated as described in Example 1 and fibres treated according to the comparison example by worsted spinning and hand dyeing. The sample from Example 1 had a boiling shrinkage of 4.8% in the raw yard and a more open, softer hand and stronger gloss than the comparison sample which had a boiling shrinkage of 8.5% in the yarn.

Comparison to Example 2:

Using equal parts of polymers of the following compositions

C. 93.5% acrylonitrile, 5.5% methyl acrylate, 1.0 % methacroylaminobenzene-benzenedisulphonimide; and D. 89.5% acrylonitrile, 9.5% methyl acrylate, 1.0% methacroylaminobenzene-benzenedisulphonimide; side-by-side composite fibres with a residual solvent content of about 16% dimethylformamide were produced by a dry-spinning process and combined to a yarn cable with a total mass per length of 203 g/m. The cable was stretched by 1:1.2 in boiling water which contained a maximum of 8% dimethylformamide, and then washed in water at 78° C which contained a maximum of 5% dimethylformamide and then again stretched by 1:2.5 in fresh water at 98° C so that the total stretch was 1:3.0. A finish was then applied and the cable was dried under tension at 130° C. It still contained 2.0 % dimethylformamide. Staple fibres of the mechanically crimped cable were steamed at a temperature of 130° C under atmospheric pressure. They had a residual dimethylformamide content of 1.1%. The residual boiling shrinkage was 1.0%, the titre of the fibres 6.0 dtex, the tensile strength 2.1 g/dtex and elongation on tearing 43%. After boiling and drying at 80° C, the fibre developed 6.9 crimp arcs per cm.

EXAMPLE 2

The process described in the Example 1 was modified in that the preliminary stretching of the fibre cable was carried out in a boiling bath containing 28.5% dimethylformamide, "washing" was carried out in the presence of 18.0 % dimethylformamide, and a bath concentration of 16.6% dimethylformamide was used in the final stretching process. The fibres contained 4.4% dimethylformamide after drying and 1.5% dimethylformamide after steaming. The residual boiling skrinkage was 1.6% the titre of the fibres 5.5 dtex, the tensile strength 2.3 g/dtex, the elongation on tearing 41% and the development of crimp 5.5 crimp arcs per cm.

Worsted yarn produced from the fibres treated as described in Example 2 and from the comparison example were hank dyed in a single bath. The yarn shrinkages were then found to be 0.4% for the fibres from Example 2 and 6.1% for the fibres from the comparison Example. When comparing the knitted samples, that from Example 2 was assessed as distinctly softer, glossier and with a greater springy elasticity.

Comparison to Example 3

Polymers of the following compositions

E. 93.6% acrylonitrile, 5.8% methyl acrylate, 0.6% sodium methallylsulphonate; and F. 99.4% acrylonitrile, 0.6% sodium methallylsulphonate; were used in the ratio of E : F = 52 : 48 to spin side-by-side composite fibres with a solvent content of about 16% dimethylformamide. A fibre cable starting with a mass per length of 53 g/m was stretched by 1 : 4.4 in boiling water which contained a maximum of 6% dimethylformamide, washed in water at 80° C in the presence of a maximum of 3% dimethylformamide, brightened, dried at 130° C with 10% shrinkage, crimped in a compression chamber and cut up to a staple length of about 120 mm. Steaming at 106° C under normal pressure resulted in fibres with a residual dimethylformamide content of 0.4% and a residual boiling shrinkage of 0.5%. The titre of the fibres was 2.8 dtex, the tensile strength 2.7 g/dtex and the elongation on tearing 49%. The fibres developed 11.8 crimp arcs per cm after boiling and drying at 80° C.

EXAMPLE 3

A fibre cable obtained from the corresponding comparison example was stretched by 1 : 4.4 in a boiling water bath which contained 14.6% dimethylformamide. The tow a was then brightened and dried, crimped and cut up in a similar manner. The fibres conrained 2.5% dimethylformamide after drying and 1.8% after steaming. The residual boiling shrinkage was 0%, the development of crimp 8.5 crimp arcs per cm. the titre of the fibre was 2.9 dtex, the tensile strength 2.7 g/dtex and the elongation on tearing 48%.

The boiling shrinkage of the raw yarn from Example 3 was 4.8% and that from the comparison example was 6.3%. When knitted-up, the sample from Example 3 was softer, smoother and slightly less bulky than the fuller but rougher and duller sample from the comparison example.

We claim:

1. A process for the production of spontaneously crimping polyacrylonitrile composite fibers which comprises side-by-side spinning of two different acrylonitrile polymers in dimethylformamide solution by the dry-spinning process , stretching the fibers which still contain dimethyl-formamide to at least three times their original length in a bath of hot water which contains from 12 to 30%, by weight, of dimethylformamide, and drying the stretched fibers under tension or under conditions of partial shrinkage.

2. The process of claim 1, wherein said stretching is carried out in a single stage.

3. The process of claim 1, wherein said stretching is carried out in two stages.

4. The process of claim 1, wherein said dry-spun material is passed through at least one bath of hot water containing from 12 to 20%, by weight, of dimethylformamide after said stretching operation or between two stretching stages.

5. The process of claim 1, wherein said different acrylonitrile polymers differ from each other in the proportions of copolymerized carboxylic acid esters.

6. The process of claim 5, wherein said carboxylic acid ester is selected from the group consisting of acrylic acid ester and carboxylic acid vinyl ester.

7. The process of claim 1 wherein the stretching is carried out at temperatures of about 98°—100° C and the stretch ratio is from 1:3.0 to 1:4.5

* * * * *